US006540871B1

(12) United States Patent
Rumph

(10) Patent No.: US 6,540,871 B1
(45) Date of Patent: Apr. 1, 2003

(54) METHOD FOR PROCESSING BLACK LIQUOR SEDIMENT

(75) Inventor: Robert Rumph, Sumter, SC (US)

(73) Assignee: The Maitland Company, Sumter, SC (US)

( * ) Notice: Subject to any disclaimer, the term of this patent is extended or adjusted under 35 U.S.C. 154(b) by 0 days.

(21) Appl. No.: 09/467,902

(22) Filed: Dec. 21, 1999

(51) Int. Cl.[7] ..... D21C 11/00; D21C 11/06

(52) U.S. Cl. ..... 162/16; 162/29; 162/189; 162/263; 162/DIG. 9

(58) Field of Search ..... 162/16, 29, 30.1, 162/30.11, 31, 189, 190, 191; 366/196, 14, 61, 331

(56) References Cited

U.S. PATENT DOCUMENTS

| | | | | | |
|---|---|---|---|---|---|
| 3,709,664 A | * | 1/1973 | Krekeler et al. | ..... | 23/285 |
| 4,030,968 A | | 6/1977 | Goel et al. | ..... | 162/16 |
| 4,273,191 A | | 6/1981 | Hradel | ..... | 166/305 |
| 4,537,941 A | | 8/1985 | Kambanis et al. | ..... | 527/403 |
| 4,808,264 A | | 2/1989 | Kignell | ..... | 162/30.1 |
| 4,872,950 A | | 10/1989 | Andersson et al. | ..... | 162/15 |
| 5,143,579 A | * | 9/1992 | Field et al. | ..... | 162/30.1 |
| 5,275,487 A | | 1/1994 | Rumph | ..... | 366/196 |
| 5,385,402 A | * | 1/1995 | Rumph | ..... | 366/196 |
| 5,405,502 A | | 4/1995 | Palmu et al. | ..... | 162/239 |
| 5,626,423 A | | 5/1997 | Rumph | ..... | 366/270 |

FOREIGN PATENT DOCUMENTS

| | | | |
|---|---|---|---|
| JP | 036535 | * | 2/1984 |
| JP | 201524 | * | 8/1997 |

OTHER PUBLICATIONS

Lavigne, J. "Instrumentation . . . Paper Industry", 1979, Miller Freeman Publications, pp. 124, 147, 148.*

* cited by examiner

*Primary Examiner*—Dean T. Nguyen
(74) *Attorney, Agent, or Firm*—Finnegan, Henderson, Farabow, Garrett & Dunner, L.L.P.

(57) ABSTRACT

An apparatus and method are provided to reduce the size of solid clumps of material and thereby permit reuse of the material. In particular, the apparatus and method allow for reuse of sediment accumulated in a storage area for paper pulping byproducts. The sediment is conveyed from the storage area to an tank. In the tank, the sediment is agitated to produce reduced-size clumps of the sediment. The reduced-size clumps are in a slurry that is capable of being burned at least one of a facility that produces paper pulp and a facility that produces paper products.

19 Claims, 2 Drawing Sheets

METHOD FOR PROCESSING BLACK LIQUOR SEDIMENT

BACKGROUND OF THE INVENTION

1. Field of the Invention

The present invention relates to an apparatus and method for reducing the size of solid materials in a substance. The invention has particular advantages associated with processing of sediment accumulated in a storage area for paper pulping byproducts, such as black liquor.

2. Description of Related Art

Pulp is the primary raw material used in the production of most, if not all, paper products. To manufacture pulp, reduced-size pieces of cellulose containing materials, usually wood, are exposed to a liquid solution, sometimes referred to as "white liquor". The white liquor dissolves certain organic components of the wood, such as lignin (i.e., tree sap), and the resulting cellulosic materials are used as pulp.

Black liquor is a by-product of the pulping process. Black liquor contains considerable amounts of the dissolved organic materials, along with spent dissolving agents and other substances, such as wood fibers, water, and dirt. Because black liquor is loaded with organic materials and some relatively volatile substances, it has a heat value in BTUs that is approximately half the heat value of #6 oil. At some pulping facilities, black liquor is burned and the heat from this combustion is used in the manufacture of additional pulp or in a paper making process. Alternatively, the black liquor is treated to remove some of its dissolved substances and this treated liquor- is reused for further pulp manufacture.

Regardless of whether black liquor is burned or reused, it is usually stored for a period of time in one or more storage tanks or lagoons at a pulping facility. During storage, heavy solids, pulp residue, and lignin settle in these storage areas, and over time the sediment accumulates to an extent that requires cleaning. In a typical cleaning procedure, excess liquid is drained from the storage area and the sediment is shoveled out either manually or through the use of construction equipment. Sometimes the sediment is vacuumed into a truck similar to a dump truck.

After black liquor sediment is removed from a storage area, it usually has relatively large clumps of solid material that are unsuitable for use as fuel or for recycling. Currently, there is no effective way of processing black liquor sediment so that it can be reused. Accordingly, black liquor sediment is normally dumped in landfills. However, landfill disposal of black liquor sediment has a number of drawbacks.

Current landfill regulations require black liquor sediment to be neutralized from its relatively high PH of 10–12 to a more neutral PH of 7–8 before it is disposed. Black liquor sediment is neutralized by mixing it with a neutralizing agent that is normally added in a one to one ratio with the black liquor sediment. For example, 100 tons of black liquor sediment is mixed with 100 tons of neutralizing agent before landfill disposal. This is a relatively expensive process that requires purchasing a substantial amount of neutralizing agent, transporting both the sediment and the neutralizing agent to the landfill site, and filling a considerable amount of landfill space. In addition, the disposed black liquor sediment contains a significant amount of potential combustion heat value that is never used.

In light of the foregoing, there is a need for processing sediment that includes byproducts of paper pulping.

SUMMARY OF THE INVENTION

Accordingly, the present invention is directed to a method and apparatus that substantially obviate one or more of the limitations of the related art. To achieve these and other advantages and in accordance with the purposes of the invention, as embodied and broadly described herein, the invention may include a method of processing sediment accumulated in a storage area for containing paper pulping byproducts. Such a method includes conveying the sediment from the storage area to a tank. In the tank, clumps of the sediment are shredded to reduce their size and these reduced-size clumps are removed from the tank. Preferably, the reduced-size clumps are capable of being used in a facility that produces pulp and/or a facility that produces paper.

In an aspect of the invention, the sediment may be black liquor sediment and the clumps removed from the tank may be in a slurry form that is capable of being burned to provide heat that can be used in another process.

In another aspect, the method may include detecting at least one of the amount of solids in the slurry and the amount of liquid in the slurry, and adding liquid to the tank. Such a method may also include controlling at least one of the flow of liquid to the tank and the flow of the sediment to the tank based on at least one of the detected amount of solids and the detected amount of liquid.

In a further aspect, the slurry may be passed through a grinder to grind any relatively larger-size solid substances in the slurry.

In yet another aspect, flow rate of the slurry may be detected and information regarding the flow rate is recorded.

In an even further aspect, the shredding of the sediment may include rotating at least one blade in an interior of the tank. During rotation of the blade, a tip of the blade preferably moves adjacent to at least one shearing element located along an inner surface of the tank. This shears clumps of the sediment located between the blade and the shearing element.

In a preferred practice of the invention, the tank is mounted on a mobile wheeled chassis, and the method further includes transporting the tank to another storage area after removal of at least a substantial amount of sediment from the initial storage area.

Additionally, the present invention may include an agitation apparatus including at least one shearing element provided on an interior surface of the tank. The shearing element may be located in the tank such that when the blade rotates, a tip of the blade passes adjacent to the shearing element to shear solid substances between the blade and the shearing element. In a preferred embodiment, the shearing element may be at least one bar extending along the longitudinal axis of the tank.

In an additional aspect, the apparatus may include a solid/liquid detector configured to detect the amount of solids and/or the amount of liquid in the substances removed from the tank. Structure is provided for controlling flow of the substances into the tank based upon the detected amount of liquid and/or the detected amount of solids.

Optionally included in the apparatus are a discharge pump configured to remove substances from the tank, a grinder for grinding the removed substances, and/or a flow rate detector configured to detect the flow rate of removed substances.

In an even further aspect, at least one inflow conduit and at least one vacuum pump are coupled to the tank. The vacuum pump provides a vacuum force in the conduit. Optionally, a flow valve is flow coupled to the inflow conduit.

While the invention has particular applicability in recycling pulping by-products, it may be used to process many different products having liquid and solid/semi-solid constituents. Thus, it is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate an embodiment of the invention and, together with the description, serve to explain the principles of the invention. In the drawings.

DESCRIPTION OF THE PREFERRED EMBODIMENT

Figure 1:
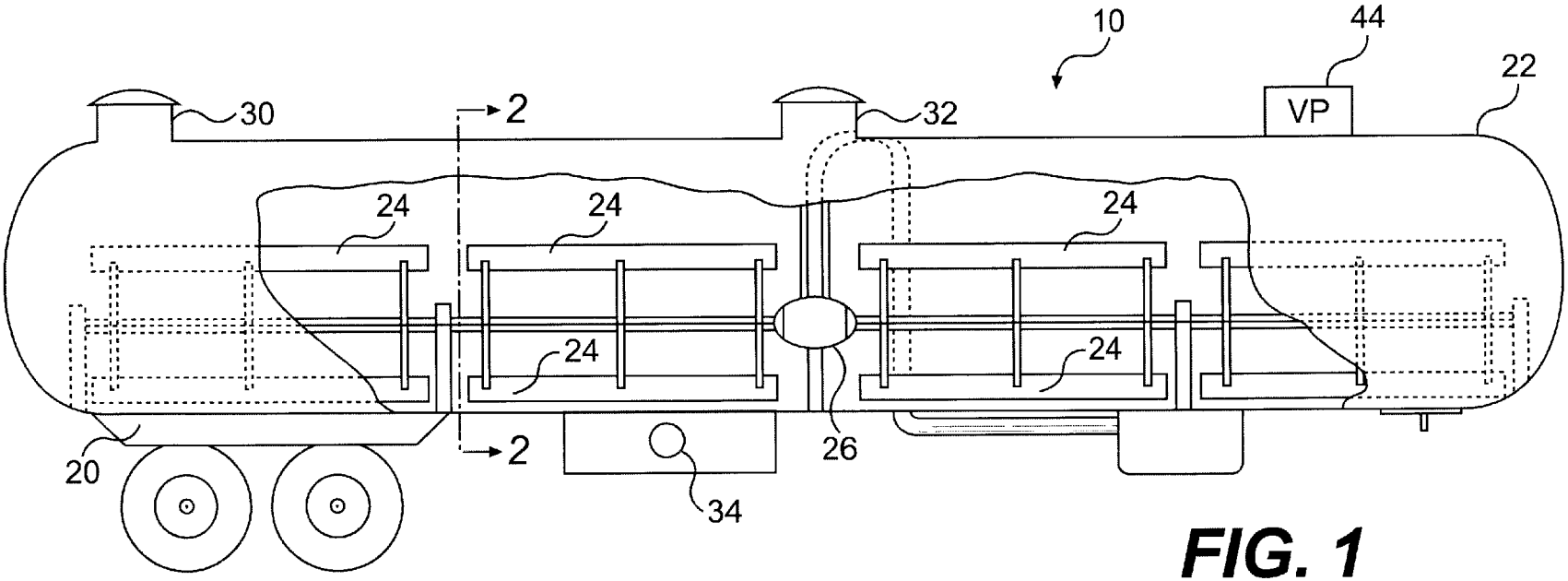
FIG. 1 is a partially schematic side view of a preferred embodiment of an apparatus constructed in accordance with the invention, with portions of a tank wall broken away to reveal internal components.

Reference will now be made in detail to the present preferred embodiment of the invention, an example of which is illustrated in the accompanying drawings. Wherever possible, the same reference numbers are used in the drawings and the description to refer to the same or like parts.

Figure 2:
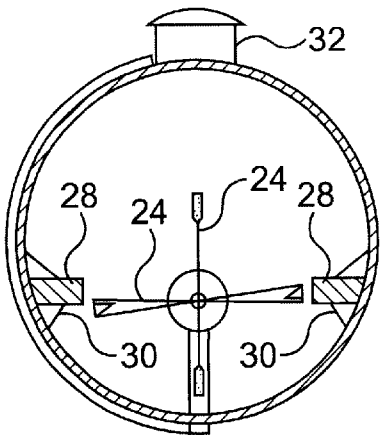
FIG. 2 is a cross-sectional view taken along lines 2—2 of FIG. 1.
Figure 3:
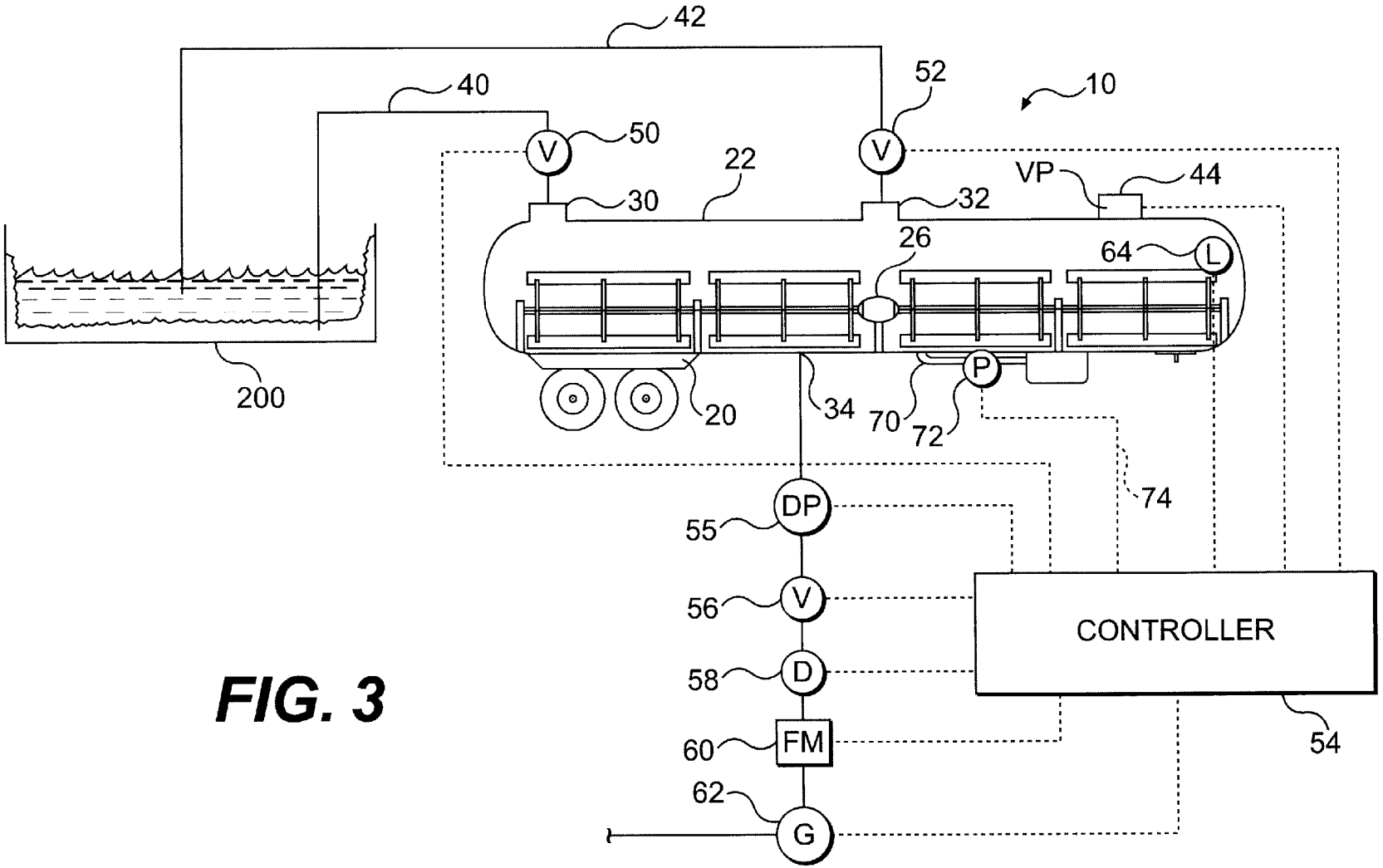
FIG. 3 is a schematic view showing fluid flow and electrical interconnection for various components of the apparatus of FIG. 1.

FIGS. 1–3 show an embodiment of an agitation apparatus 10 constructed in accordance with the present invention. As shown in FIG. 1, the agitation apparatus 10 includes a mobile wheeled chassis 20, a tank 22 mounted on the chassis 20, one or more blades 24 mounted for rotation in an interior of the tank 22, and a motor 26 capable of rotating the blades 24. Preferably, the chassis 20, tank 22, blades 24, and motor 26 are constructed like those of the apparatus disclosed in U.S. Pat. No. 5,275,487, issued Jan. 4, 1994, the disclosure of which is incorporated herein by reference in its entirety. In a preferred practice of the invention, the motor 26 is more powerful and faster than the motor normally used in the apparatus disclosed in U.S. Pat. No. 5,275,487, but those of ordinary skill in the art should recognize that any suitable motor could be used.

The blades 24 extend along the length of the tank 22. During activation of the motor 26, the blades 24 rotate about an axis of rotation that is at least substantially parallel with a longitudinal, horizontal axis of the tank 22. As explained in more detail below, the rotation of the blades 24 shreds (i.e., agitates) materials added to the tank 22 to reduce the size of solid substances. For example, the apparatus 10 is preferably configured to be capable of reducing large clumps of black liquor sediment to form a slurry that can be burned to provide heat for a pulping facility and/or a paper making facility.

As shown in FIG. 2, one or more shearing elements 28 are provided on opposite portions of an inner wall surface of the tank 22. Each of the shearing elements 28 is located in the tank 22 such that when the blades 24 rotate, tips of the blades 24 pass adjacent to free ends of the shearing elements 28 to shear solid substances between the blades 24 and the shearing elements 28. This ensures that relatively large substances in the tank 22 are reduced in size during rotation of the blades 24. Thus, the presence of shearing elements 28 renders tank 22 a "shredder tank." While one example of a shredder tank is depicted in the figures, the invention, in its broadest sense is not so limited. The invention may include various structures capable of reducing particular clump size. The term "shredder tank" is therefore intended to encompass all such structures.

To provide additional support for the shearing elements 28, gussets 30 may be welded to the tank 22 and the shearing elements 28. In the preferred embodiment, each of the shearing elements 28 is an elongated bar of material that extends along the longitudinal axis of the tank 22 from one end of the tank 22 to another. For example, each of the shearing elements 28 could be a flat bar of material having a rectangular, 4 inch ×¼ inch cross-section with adjacent edges forming 90° angles. In one configuration that works well with black liquor, a space between the blades 24 and shearing elements 28 is approximately 1/16 of an inch. Alternatively, the shearing elements 28 could be a number of other structural configurations. For example, the shearing elements could be a unitary ridge integral with the wall of the tank 22 (not shown), stationary blades on the wall of the tank 22 (not shown), or any structural part of the wall itself.

The tank 22 preferably has one or more inlets to allow for loading of substances to be processed and one or more outlets to allow for removal of processed substances. As shown in FIG. 1, the tank 22 preferably includes a first inlet 30, a second inlet 32, and an outlet 34. The inlets 30 and 32 and outlet 34 are preferably capable of being sealed during transportation of the apparatus 10.

FIG. 3 shows additional components of the apparatus 10 in partially schematic form. Broken lines in this figure generally represent electrical communication between various structural components and solid lines generally represent fluid flow paths.

As shown in FIG. 3, the apparatus 10 further includes a first inflow conduit 40 removably attached to the tank 22 at the first inlet 30 and a second inflow conduit 42 removably attached to the tank 22 at the second inlet 32. In addition, at least one vacuum pump 44 is mounted on the tank 22. The vacuum pump 44 creates vacuum force in the interior of the tank 22 and this vacuum force is transmitted through the conduits 40 and 42 to pull substances into the conduits 40 and 42 and convey these substances into the interior of the tank 22 via the first and second inlets 30 and 32. In a preferred embodiment, the vacuum pump 44 may be a diesel powered, blower-type pump capable of generating vacuum flow in the conduits 40 and 42 that is approximately 4000 cubic feet per minute, for example.

The inflow conduits 40 and 42 are flexible hoses each having an inlet end capable of being placed in a storage area 200, which is preferably a storage tank or lagoon containing byproducts of paper pulping, such as black liquor. As shown in FIG. 3, the inflow end of the first conduit 40 is positioned adjacent to a lower part of the storage area 200 to remove primarily solid sediment substances (including, for example, clumps of sediment) in the storage area 200 and the second conduit 42 is positioned in an upper part of the storage area 200 to remove primarily liquid substances from the storage area 200. Optionally, inflow ends of the conduits 40 and 42 could be mounted on the front end of a separate vehicle (not shown), such as a small tractor with a hydraulically operated snow blower auger, which is capable of being driven around the storage area 200 to provide rapid removal of a substantial amount of sediment.

A respective flow valve 50, 52 is flow coupled to each of the inflow conduits 40 and 42. The flow valves 50 and 52 are individually controlled by a programmable controller 54 (computer) to adjust the relative amounts of solid substances and liquid substances, respectively, that enter the tank 22. There are a number of other structures that could be used to control flow of the substances into the tank 22. For example, an individual pump (not shown) could be flow coupled to each of the conduits 40 and 42 and flow rates could be adjusted by controlling the pumps. Alternatively, when the valves 50 and 52 are knife gate valves, the flow could be adjusted by controlling the pumps and opening and closing the valves.

A discharge pump 55 is in flow communication with the outlet 34 to remove agitated substances from the interior of the tank 22. Although many different types of pumping devices could be used, the discharge pump 55 is preferably a centrifugal pump configured to generate a relatively large vacuum force. Downstream from the discharge pump 55, the apparatus 10 has a flow valve 56, a solid/liquid detector 58, a flow meter 60, and a grinder 62. The flow valve 56 regulates outflow of substances from the discharge pump 55. Preferably, the flow valve 56 is controlled during rotation of the blades 24 to ensure that the tank 22 is at least approximately half full.

The solid/liquid detector 58 is configured to detect the amount of solids and/or the amount of liquid removed from the tank 22 via the outlet 34 and to transmit this information to the controller 54. The controller 54 controls the flow valves 50 and 52 to ensure that the amounts of liquid and solid material added to the tank 22 are sufficient to establish appropriate amounts of solid and liquid material in the substances removed from the tank 22. For example, when the detector 58 senses a relatively thick (i.e., high solid content) outflow from the tank 22, one or more of the flow valves 50 and 52 is controlled to increase the relative flow of liquid through the second conduit 42. Conversely, when the detector 58 senses a relatively thin (i.e., low solid content) outflow from the tank 22, one or more of the flow valves 50 and 52 is controlled to increase the relative flow of solids through the first conduit 40. During processing of black liquor sediment, this regulation of the solid and liquid content is particularly advantageous to facilitate providing a final product that is capable of being burned at a facility.

The flow meter 60 detects the flow rate of substances removed from the tank 22 to determine the total amount of substances processed by the apparatus 10. This information is then fed back to the controller 54 and preferably retained for a period of time, for example, for billing purposes. Preferably, the flow meter 60 is an electronic probe that lacks moving parts in the substance flow path.

The grinder 62 may be arranged to reduce the size of any relatively larger size solid substances flowing from the tank 22. In an embodiment of the present invention, the grinder 62 may have a rotating impeller for ensuring that substances leaving the grinder 62 do not have a maximum cross-sectional dimension (i.e., diameter) greater than about 1/16 inch. For example, the grinder 62 could be a Moyno grinder pump.

Various other monitors and devices could be included in the apparatus 10. For example, the apparatus includes a level detector 64 for detecting the level of substances in the tank 22. As shown in FIG. 3, the valves 50, 52, 56, vacuum pump(s) 44, discharge pump 55, solid/liquid detector 58, flow meter 60, grinder 62, and level detector 64 are all electrically interconnected to the controller 54 to permit relatively automatic control and monitoring of the apparatus 10. For example, the controller 54 could control the valve 56 based on the level detected by the level detector 64.

In an alternative embodiment, flow through conduits 40 and 42 may be regulated as a function of the pressure necessary to turn hydraulic motor 26. As the particle size of sediment increases, so to does the pressure in hydraulic line 70, as measured by pressure guage 72. This is because larger particles place a greater strain on motor 26. While optimum viscosity and associated pressure will vary from project to project, once an optimum viscosity is achieved controller 54 may be programmed to regulate valves 50 and 52 to maintain a mixture which maintains optimum hydraulic pressure, and as a result, optimum viscosity. As an alternative to computer control, an operator may visually monitor the hydraulic pressure, and manually control valves 50, 52 and 56 accordingly.

There are many other ways in which the valves 50, 52, and/or 56 could be controlled. For example, when the motor 26 is an electric motor, current applied to the motor 26 could be monitored to determine load applied to the motor 26 and this information could be used to control the valves 50, 52, and 56.

In accordance With the invention, there is also provided a method of processing sediment accumulated in a storage area for paper pulping byproducts. This method is explained with reference to the structural embodiment described above. However, it should be understood that the method of the invention could be practiced with structure other than that disclosed herein. In addition, the structure of the present invention could be used with processes other than those described herein.

Preferably, the apparatus 10 is transported to a location having a byproduct storage area 200 that is in need of cleaning. For example, the apparatus 10 shown in FIG. 1 is in the form of a trailer capable of being towed by a tractor truck. The apparatus could also be transported in variety of other ways via an automobile road, railroad, etc. For example, the apparatus could be a railroad car or a part of a truck rather than being merely a trailer pulled by a truck. Alternatively, the apparatus could be provided as a stationary unit adjacent to the storage area 200.

Initially, the first and second inflow conduits 40 and 42 may be removably coupled to the tank 200. Inlet ends of the conduits 40 and 42 are positioned in the storage area 200 so that the first conduit 40 removes primarily solid sediment and the second conduit 42 removes primarily liquid. When the storage area 200 does not contain a significant amount of liquid, the inlet end of the second conduit 42 is alternatively placed in flow communication with a different source of liquid, such as a second storage area, similar to the storage area 200, or a heated water discharge at a paper mill.

The controller 54 operates the vacuum pump 44 to produce vacuum force in the interior of the tank 22 and in the inflow conduits 40 and 42. Then, the controller 54 operates the valves 50 and 52 to convey both solids and liquid into the tank 22. Preferably, the valves 50 and 52 are operated to convey solids and liquids simultaneously. Alternatively, liquid could be conveyed into the tank 22 before conveying the solids.

For example, the solids entering the tank 22 may be in clumps with an approximate maximum cross-sectional dimension (i.e., diameter) of about 6 inches to about 10 inches. In an embodiment of the invention, the solids and liquid enter the tank 22 at a flow rate of about 400 gallons per minute.

The motor 26 is actuated to rotate the blades 24 about their axis of rotation. The rotating blades 24 agitate the solid and liquid substances entering the tank 22 to generally reduce the size of the solid clumps. These clumps are further reduced when tips of the blades 24 rotate adjacent to the shearing elements 28 and thereby shear substances therebetween.

The rotation of blades 24 in tank 22 also serves to mix the reduced size clumps with a more fluid substance such as liquid which is drawn into tank 22 through conduit 42. When a mixture is formed, the liquid serves as a carrier for the reduced size clumps.

The controller 54 operates the discharge pump 55 to remove from the tank 22 the substances including the reduced-size clumps. In one preferred practice of the present invention, the substances flowing from the outlet 34 of the tank 22 have a slurry consistency similar to "oatmeal".

The detector 58 may monitor the relative amount of solid and/or liquid in the substances removed from the tank 22. Based on this information, the controller 54 preferably regulates the solid and liquid flow into the tank 22 by controlling the valves 50 and 54. This ensures that the substance flowing from the tank 22 has a relatively controlled amount of solids and liquid.

In one preferred embodiment, the flow monitor 60 detects the flow rate of the substances. Then, the substances pass into the grinder 62 to ensure that all of the particles are below a particular size. Thereafter, the resulting substances may be reintroduced into a pulping facility and/or a paper making facility. For example, where black liquor is contained within storage area 200, the byproduct flow from outlet 34 may be conveyed into the white liquor stream of a paper plant. Alternatively, the byproduct may be conveyed to any other location where it could be burned to generate heat or used in some other manner. Thus, black liquor sediment that would have otherwise been a waste product is recycled for further use. In the preferred practice of the invention, this significantly reduces the amount of landfill disposal that would otherwise be required if the black liquor sediment was merely buried.

When a substantial amount of the sediment is removed from the storage area 200, the wheeled chasis 20 of apparatus 10 permits apparatus 10 to be transported to another storage area in need of cleaning. This allows for cleaning of a plurality of storage areas with a single apparatus.

It will be apparent to those skilled in the art that various modifications and variations can be made to the structure and methodology of the present invention without departing from the scope or spirit of the invention. For example, the present invention could be practiced to process other types of byproducts at a pulping facility and/or a paper making facility. Alternatively, the apparatus of the present invention could be used to process substances other than those that are related to pulp and paper making, including but not limited to clay slurries, hazardous waste, or any other material having solid and liquid constituents. In view of the foregoing, it is intended that the present invention cover modifications and variations of this invention provided they fall within the scope of the following claims and their equivalents.

What is claimed is:

1. A method of enabling recycling of a by product of a pulping process, comprising:

conveying clumps of sediment to a tank, the sediment being sediment of a shredding the clumps of sediment to reduce the clumps to sizes capable of use in at least one of a paper making process and a pulping process; and removing the reduced-size clumps from the tank.

2. The method of claim 1, wherein the shredding includes rotating at least one blade in an interior of the tank.

3. The method of claim 2, wherein during the rotation of the blade a tip of the blade moves adjacent to at least one shearing element located along an inner surface of the tank, and wherein clumps of the sediment located between the blade and the shearing element are sheared.

4. The method of claim 1, wherein the sediment includes solids and at least some liquid.

5. The method of claim 1, wherein the removing includes conveying the clumps of sediment from a storage area to the tank.

6. The method of claim 5, wherein the storage area is a storage area for black liquor and wherein the sediment is black liquor sediment.

7. The method of claim 6, wherein the reduced-size clumps removed from the tank are in a slurry.

8. The method of claim 7, further comprising burning the slurry and using heat from the slurry combustion in at least one of a pulping process and a paper making process.

9. The method of claim 7, further comprising detecting at least one of the amount of solids in the slurry and the amount of liquid in the slurry, adding liquid to the tank, and controlling at least one of the flow of liquid to the tank and the flow of the sediment to the tank based on at least one of the detected amount of solids and the detected amount of liquid.

10. The method of claim 9, wherein the liquid added to the tank is liquid from black liquor contained in the storage area.

11. The method of claim 9, wherein the liquid added to the tank is from a source separate from the storage area.

12. The method of claim 7, further comprising passing the slurry through a grinder to grind any relatively larger-size clumps of the slurry.

13. The method of claim 7, further comprising detecting flow rate of the slurry and recording information regarding the flow rate.

14. The method of claim 5, wherein the conveying of clumps of the sediment to the tank includes removing the sediment from the storage area with vacuum force applied through a conduit.

15. The method of claim 5, wherein the tank is mounted on a mobile wheeled chassis and wherein the method further comprises transporting the tank to another storage area after removal of at least a substantial amount of sediment from the initial storage area.

16. The method of claim 5, wherein the storage area is at least one of a lagoon and a storage tank.

17. The method of claim 1, wherein the tank has an agitator therein; wherein the method futher comprises mixing, using the agitator, the reduced size clumps with a flowable carrier material to form a mixture; and wherein the conveying includes flowing the mixture from the tank for use in at least one of a paper making facility and a pulping facility.

18. The method of claim 17, wherein the method includes using the agitator to perform the shredding.

19. The method of claim 1, wherein the method further includes recycling the sediment.

* * * * *

UNITED STATES PATENT AND TRADEMARK OFFICE

CERTIFICATE OF CORRECTION

PATENT NO. : 6,540,871 B1
DATED : April 1, 2003
INVENTOR(S) : Robert Rumph

It is certified that error appears in the above-identified patent and that said Letters Patent is hereby corrected as shown below:

Title page,
Item [57], ABSTRACT,
Line 6, change “an” to -- a --;

Column 7,
Line 63, replace “by product” with -- byproduct --;
Line 66, after “of a”, insert -- byproduct of a pulping process; --

Signed and Sealed this

Fifteenth Day of July, 2003

JAMES E. ROGAN
*Director of the United States Patent and Trademark Office*